US012685917B1

(12) United States Patent
Terrell, II et al.

(10) Patent No.: US 12,685,917 B1
(45) Date of Patent: Jul. 21, 2026

(54) ENTERTAINMENT CONTENT-BASED EXERCISE MACHINE WORKOUT INTENSITY CONTROL SYSTEM

(71) Applicant: EXERSCREEN INC., Charlotte, NC (US)

(72) Inventors: James Richard Terrell, II, Charlotte, NC (US); Joshua Rand Terrell, Stockbridge, GA (US); Micah James Terrell, Newark, CA (US)

( * ) Notice: Subject to any disclaimer, the term of this patent is extended or adjusted under 35 U.S.C. 154(b) by 33 days.

(21) Appl. No.: 18/112,161

(22) Filed: Feb. 21, 2023

Related U.S. Application Data

(60) Provisional application No. 63/312,297, filed on Feb. 21, 2022.

(51) Int. Cl.

| | |
|---|---|
| ***A63B 71/06*** | (2006.01) |
| ***A63B 22/02*** | (2006.01) |
| ***A63B 22/06*** | (2006.01) |
| ***A63B 24/00*** | (2006.01) |

(52) U.S. Cl.
CPC ..... *A63B 71/0622* (2013.01); *A63B 22/025* (2015.10); *A63B 22/0605* (2013.01); *A63B 24/0075* (2013.01); *A63B 2024/009* (2013.01); *A63B 2071/0625* (2013.01); *A63B 2071/0655* (2013.01)

(58) Field of Classification Search
CPC ..... A63B 22/025; A63B 22/0605; A63B 2024/009; A63B 2071/0644
See application file for complete search history.

(56) References Cited

U.S. PATENT DOCUMENTS

| | | | | |
|---|---|---|---|---|
| 4,720,789 | A | 1/1988 | Hector et al. | |
| 6,179,746 | B1 * | 1/2001 | Delman | A63B 71/0622 482/902 |
| 6,227,968 | B1 | 5/2001 | Suzuki et al. | |
| 6,447,424 | B1 * | 9/2002 | Ashby | A63B 22/0023 482/8 |
| 6,450,888 | B1 | 9/2002 | Takase et al. | |

(Continued)

FOREIGN PATENT DOCUMENTS

WO WO-2022120467 A1 * 6/2022 ..... A63B 24/0059

*Primary Examiner* — Joshua T Kennedy
(74) *Attorney, Agent, or Firm* — Tillman, Wright & Wolgin; James D. Wright; David R. Higgins

(57) ABSTRACT

A computer-implemented method uses entertainment content to automatically control an exercise machine to adjust an intensity of a user workout. A content player plays entertainment content that is presented to a user. The entertainment content is tagged with intensity and timing annotations correlating to attributes of the entertainment content at various points in time. Based on the annotations, a workout manager determines a target workout parameter for each of a plurality of segments of the entertainment content. As the entertainment content is played, the target workout parameter for each respective segment, of the plurality of segments, is provided to an exercise machine. In response to receiving each target workout parameter, an operational aspect of the machine is controlled to adjust an intensity of a user workout for the duration of the respective segment, thereby synchronizing the intensity of the workout with the attributes of the entertainment content.

19 Claims, 6 Drawing Sheets

(56) References Cited

U.S. PATENT DOCUMENTS 6,605,020 B1 * 8/2003 Huang ..... A63B 22/0242 482/7
7,927,253 B2 4/2011 Vincent et al.
8,152,640 B2 4/2012 Shirakawa et al.
8,602,858 B2 12/2013 Umeda
9,636,567 B2 * 5/2017 Brammer ..... A63B 71/0622
10,726,730 B2 * 7/2020 Watterson ..... G09B 19/0038
11,801,423 B2 * 10/2023 Bissonnette ..... A63B 23/0417
2005/0075213 A1 * 4/2005 Arick ..... A63B 24/00 482/902
2006/0052163 A1 3/2006 Aida
2007/0042868 A1 * 2/2007 Fisher ..... G16H 20/30 482/902
2008/0171636 A1 * 7/2008 Usui ..... A63B 24/0062 482/8
2009/0270227 A1 * 10/2009 Ashby ..... G16H 20/30 482/8
2010/0217099 A1 8/2010 LeBoeuf et al.
2010/0292006 A1 11/2010 Terrell et al.
2011/0034300 A1 2/2011 Hall
2011/0159938 A1 6/2011 Umeda
2012/0214594 A1 8/2012 Kirovski et al.
2013/0095926 A1 4/2013 Trewartha et al.
2013/0225370 A1 * 8/2013 Flynt ..... G16H 20/30 482/4
2014/0128162 A1 5/2014 Arafat
2014/0224867 A1 8/2014 Werner et al.
2014/0228125 A1 8/2014 Tsang
2015/0120023 A1 * 4/2015 Terrell ..... A63F 13/61 700/91
2017/0006338 A1 * 1/2017 Kim ..... H04N 21/44218
2022/0347524 A1 * 11/2022 Kim ..... A63B 21/0056
2023/0181995 A1 * 6/2023 Lentine ..... A63F 13/816 482/4
2024/0017123 A1 * 1/2024 Waller ..... A63B 24/0062
2024/0157198 A1 * 5/2024 Andersen ..... A63B 24/0087
2024/0207675 A1 * 6/2024 Liu ..... A63B 22/0605

* cited by examiner

ENTERTAINMENT CONTENT-BASED EXERCISE MACHINE WORKOUT INTENSITY CONTROL SYSTEM

CROSS-REFERENCE TO RELATED APPLICATION

The present application is a U.S. nonprovisional patent application of, and claims priority under 35 U.S.C. § 119 (e) to, U.S. provisional patent application 63/312,297, filed Feb. 21, 2022, which provisional patent application is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to exercise machine control systems, and, in particular, to the control of exercise machine workout intensity based on entertainment content.

Background

A system for creating workout plans based on entertainment content and then tracking how closely workout participants match the specified workouts is described by US20150120023A1 "Entertainment content fitness gaming system" (the '023 publication), relevant portions of which are incorporated by reference herein. Workout plans may be "dynamic" in the sense that they are produced in real-time (based on live sporting events, live music, or the like), or they may be "static" in the sense that they are based on pre-recorded events.

With the rise in popularity of connected, digitally controllable fitness machines and equipment it has become possible to not only monitor how closely a workout participant is following a workout plan, per the '023 publication, but to additionally directly control the physical intensity of the workout. For example, connected cycling trainers can be controlled such that pedaling resistance can be increased or decreased, and smart treadmills can be controlled by changing belt speed and incline.

In the '023 publication, the workout user had to manually adjust their own workout intensity to match the requested intensity. For example, if a workout segment required a target workout intensity power of 100 watts to be generated, it was up to the user to run, cycle, row, etc. at an intensity of 100 watts. This could be a difficult process and limited how quickly workout intensities could be changed since the user might not be able to react quickly enough.

Thus, a need exists for a system that connects entertainment content intensity to controllable fitness equipment so the workout user no longer has to concern themselves with manually adjusting the intensity of their workout in order to hit power or intensity targets that could be changing rapidly.

One or more of the foregoing needs and/or other needs may be addressed by one or more aspects of the present invention.

SUMMARY OF THE PRESENT INVENTION

Some exemplary embodiments of the present invention may overcome one or more of the above disadvantages and other disadvantages not described above, but the present invention is not required to overcome any particular disadvantage described above, and some exemplary embodiments of the present invention may not overcome any of the disadvantages described above.

The present invention includes many aspects and features. Moreover, while many aspects and features relate to, and are described in, the context of entertainment content-based exercise machine workout intensity control, the present invention is not limited to use only in exercise machine workout intensity control, as will become apparent from the following summaries and detailed descriptions of aspects, features, and one or more embodiments of the present invention.

Broadly defined, the present invention according to one aspect relates to a computer-implemented method providing a technical solution to the technical problem of using entertainment content to automatically control an operational aspect of an exercise machine to adjust an intensity of a workout performed by a user, the method including: playing entertainment content via a content player such that the entertainment content is presented to a user, wherein the entertainment content is tagged with intensity and timing annotations correlating to attributes of the entertainment content at various points in time; based on the intensity and timing annotations, determining, via a workout manager, a target intensity parameter for each of a plurality of segments of the entertainment content; as the entertainment content is played, providing the target intensity parameter for each respective segment, of the plurality of segments of the entertainment content, to an exercise machine; and in response to receiving each target intensity parameter for each respective segment, controlling an operational aspect of the exercise machine to adjust an intensity of a workout performed by the user for the duration of the respective segment, thereby synchronizing the intensity of the workout with the attributes of the entertainment content.

In a feature of this aspect, controlling an operational aspect of the exercise machine to adjust the intensity of the workout performed by the user includes controlling the physical effort required of the user by the exercise machine. In further features, the exercise machine is a smart cycling trainer, and controlling the physical effort required of the user by the exercise machine includes controlling pedaling resistance of the smart cycling trainer; the exercise machine is a smart treadmill, and controlling the physical effort required of the user by the exercise machine includes controlling belt speed of the smart treadmill; and/or the exercise machine is a smart treadmill, and controlling the physical effort required of the user by the exercise machine includes controlling a belt incline of the smart treadmill.

In another feature of this aspect, controlling an operational aspect of the exercise machine includes controlling haptic feedback by the exercise machine to the user. In further features, the exercise machine is a smart cycling trainer, the entertainment content includes immersive video featuring different cycling surfaces, and controlling haptic feedback includes generating different vibration patterns, via the smart cycling trainer, in synchronization with the different cycling surfaces; and/or a lower intensity vibration pattern is generated for a smooth cycling surface in the immersive video, and a higher intensity vibration pattern is generated for a cobblestone or other rough cycling surface in the immersive video.

In another feature of this aspect, controlling an operational aspect of the exercise machine includes controlling the physical orientation of the exercise machine. In further features, the exercise machine is a smart cycling trainer, and controlling the physical orientation of the exercise machine includes controlling an incline of the smart cycling trainer; and/or the exercise machine is a smart treadmill, and wherein controlling the physical orientation of the exercise machine includes controlling belt incline of the smart treadmill.

In another feature of this aspect, while each respective segment of the entertainment content is presented to the user, the target intensity parameter for such segment is displayed to the user. In further features, while each respective segment of the entertainment content is presented to the user, the target intensity parameter for one or more additional segments of the entertainment content are also displayed to the user; each target intensity parameter is categorized using a fitness model that includes functional threshold power (FTP), training zones, or both; and/or each target intensity parameter is displayed using a color from a color-coded target intensity parameter range.

In another feature of this aspect, the method further includes a step of tagging the entertainment content with the intensity and timing annotations via a content tagger. In further features, the step of tagging the entertainment content is carried out during the step of playing the entertainment content; the entertainment content is a live band leading a workout remotely or in person; the entertainment content is a live "fitness DJ" creating a musical workout experience remotely or in person; and/or the step of tagging the entertainment content is carried out ahead of time and the intensity and timing annotations are stored with the entertainment content for later execution of the playing step.

Broadly defined, the present invention according to one aspect relates to a system using entertainment to provide automated control of an operational aspect of an exercise machine in order to adjust an intensity of a workout performed by a user, including: a content player that presents entertainment content to a user, wherein the entertainment content is tagged with intensity and timing annotations correlating to attributes of the entertainment content at various points in time; a workout manager that determines, based on the intensity and timing annotations, a target intensity parameter for each of a plurality of segments of the entertainment content; and an exercise machine that receives the target intensity parameter for each respective segment and controls an operational aspect to adjust an intensity of a workout performed by a user for the duration of the respective segment, thereby synchronizing the intensity of the workout with the attributes of the entertainment content.

In a feature of this aspect, the intensity of a workout is adjusted by controlling the physical effort required of the user by the exercise machine. In further features, the exercise machine is a smart cycling trainer with adjustable pedaling resistance, and the intensity of a workout is adjusted by controlling the pedaling resistance of the smart cycling trainer; the exercise machine is a smart treadmill with an adjustable belt speed, and the intensity of a workout is adjusted by controlling the belt speed of the smart treadmill; and/or the exercise machine is a smart treadmill with an adjustable belt incline, and the intensity of a workout is adjusted by controlling the belt incline of the smart treadmill.

In another feature of this aspect, the exercise machine generates a haptic effect that is controlled to adjust the intensity of a workout. In further features, the exercise machine is a smart cycling trainer, the entertainment content includes immersive video featuring different cycling surfaces, and controlling the haptic effect includes generating different vibration patterns, via the smart cycling trainer, in synchronization with the different cycling surfaces; and/or a lower intensity vibration pattern is generated for a smooth cycling surface in the immersive video, and a higher intensity vibration pattern is generated for a cobblestone or other rough cycling surface in the immersive video.

In another feature of this aspect, the exercise machine has an adjustable physical orientation that is controlled to adjust the intensity of a workout. In further features, the exercise machine is a smart cycling trainer with an adjustable incline, and the intensity of a workout is adjusted by controlling the incline of the smart cycling trainer; and/or the exercise machine is a smart treadmill with an adjustable belt incline, and wherein the intensity of a workout is adjusted by controlling the belt incline of the smart treadmill.

In another feature of this aspect, the workout manager displays the target intensity parameter for each segment of the entertainment content as the entertainment content segment is presented to the user. In further features, while each respective segment of the entertainment content is presented to the user, the workout manager also simultaneously displays the target intensity parameter for one or more additional segments of the entertainment content; each target intensity parameter is categorized using a fitness model that includes functional threshold power (FTP), training zones, or both; and/or each target intensity parameter is displayed using a color from a color-coded target intensity parameter range.

In another feature of this aspect, the system further includes a content tagger that analyzes the entertainment content and associates intensity and timing annotations therewith, the annotations correlating to attributes of the entertainment content at various points in time. In further features, the content tagger associates intensity and timing annotations with the entertainment content while the entertainment content is presenting the entertainment content; the entertainment content is a live band leading a workout remotely or in person; the entertainment content is a live "fitness DJ" creating a musical workout experience remotely or in person; and/or the content tagger associates intensity and timing annotations with the entertainment content ahead of time, and the intensity and timing annotations are stored with the entertainment content for later execution.

Broadly defined, the present invention according to one aspect relates to a computer-implemented method providing a technical solution to the technical problem of using entertainment content to automatically control an operational aspect of an exercise machine to adjust an intensity of a workout performed by a user, the method including: while playing entertainment content via a content player such that the entertainment content is presented to a user, receiving, at a workout manager, intensity and timing annotations, associated with the entertainment content, that correlate to attributes of the entertainment content at various points in time; based on the intensity and timing annotations, determining, via the workout manager, a target intensity parameter for each of a plurality of segments of the entertainment content; and as the entertainment content is played, providing the target intensity parameter for each respective segment, of the plurality of segments of the entertainment content, to an exercise machine such that an operational aspect of the exercise machine is controlled in order to adjust an intensity of a workout performed by the user for the duration of the respective segment, thereby synchronizing the intensity of the workout with the attributes of the entertainment content.

In a feature of this aspect, providing the target intensity parameter for each respective segment to the exercise machine such that an operational aspect of the exercise machine is controlled in order to adjust an intensity of a workout performed by the user includes controlling the physical effort required of the user by the exercise machine. In further features, the exercise machine is a smart cycling trainer, and controlling the physical effort required of the user by the exercise machine includes controlling pedaling resistance of the smart cycling trainer; the exercise machine is a smart treadmill, and controlling the physical effort required of the user by the exercise machine includes controlling belt speed of the smart treadmill; and/or the exercise machine is a smart treadmill, and controlling the physical effort required of the user by the exercise machine includes controlling a belt incline of the smart treadmill.

In another feature of this aspect, providing the target intensity parameter for each respective segment to the exercise machine such that an operational aspect of the exercise machine is controlled in order to adjust an intensity of a workout performed by the user includes controlling haptic feedback by the exercise machine to the user. In further features, the exercise machine is a smart cycling trainer, the entertainment content includes immersive video featuring different cycling surfaces, and controlling haptic feedback includes generating different vibration patterns, via the smart cycling trainer, in synchronization with the different cycling surfaces; and/or a lower intensity vibration pattern is generated for a smooth cycling surface in the immersive video, and a higher intensity vibration pattern is generated for a cobblestone or other rough cycling surface in the immersive video.

In another feature of this aspect, providing the target intensity parameter for each respective segment to the exercise machine such that an operational aspect of the exercise machine is controlled in order to adjust an intensity of a workout performed by the user includes controlling the physical orientation of the exercise machine. In further features, the exercise machine is a smart cycling trainer, and controlling the physical orientation of the exercise machine includes controlling an incline of the smart cycling trainer, the exercise machine is a smart treadmill, and wherein controlling the physical orientation of the exercise machine includes controlling belt incline of the smart treadmill.

In another feature of this aspect, while each respective segment of the entertainment content is presented to the user, the target intensity parameter for such segment is displayed to the user. In further features, while each respective segment of the entertainment content is presented to the user, the target intensity parameter for one or more additional segments of the entertainment content are also displayed to the user; each target intensity parameter is categorized using a fitness model that includes functional threshold power (FTP), training zones, or both; and/or each target intensity parameter is displayed using a color from a color-coded target intensity parameter range.

In another feature of this aspect, the method further includes a step of tagging the entertainment content with the intensity and timing annotations via a content tagger. In further features, the step of tagging the entertainment content is carried out during the step of playing the entertainment content; the entertainment content is a live band leading a workout remotely or in person; the entertainment content is a live "fitness DJ" creating a musical workout experience remotely or in person; and/or the step of tagging the entertainment content is carried out ahead of time and the intensity and timing annotations are stored with the entertainment content for later execution of the playing step.

Broadly defined, the present invention according to another aspect relates to a method of automatically controlling one or more content playback parameters by user manipulating a smart exercise machine.

In a feature of this aspect, the step of controlling one or more content playback parameters includes starting content playback by starting to pedal on a smart cycling trainer.

In another feature of this aspect, the step of controlling one or more content playback parameters includes pausing content playback by stopping pedaling.

In another feature of this aspect, the step of controlling one or more content playback parameters includes fast-forwarding or reversing content playback by steering left or right on a cycling trainer that can sense handlebar steering position.

In another feature of this aspect, the step of controlling one or more content playback parameters includes using electronic shifters present on some cycling trainers.

Further areas of applicability of the present invention will become apparent from the detailed description provided hereinafter. It should be understood that the detailed description and specific examples, while indicating preferred embodiment(s) of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
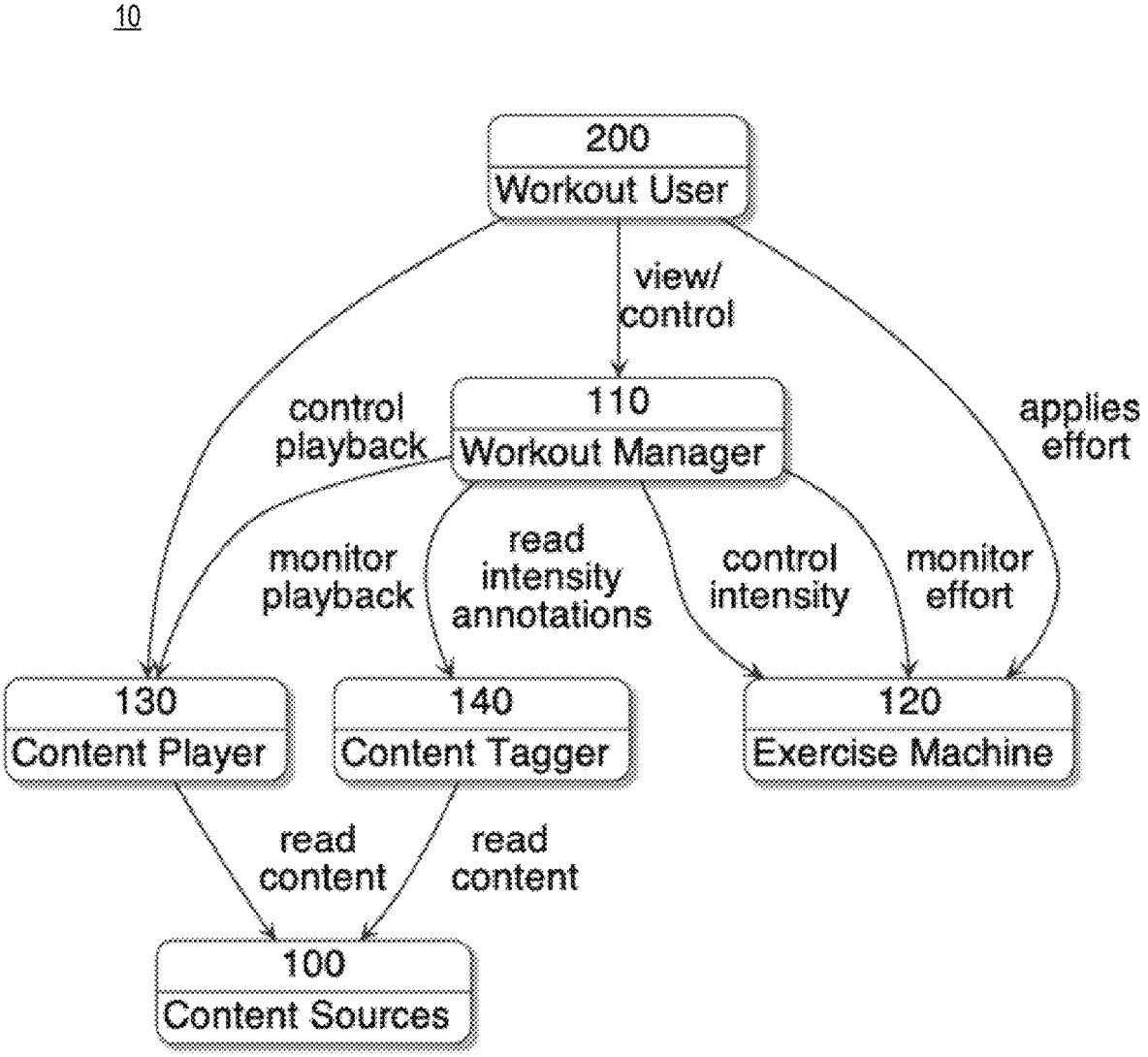
FIG. 1 is an entity relationship diagram of an entertainment content exercise machine workout intensity control system in accordance with one or more preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Furthermore, an embodiment of the invention may incorporate only one or a plurality of the aspects of the invention disclosed herein; only one or a plurality of the features disclosed herein; or combination thereof. Moreover, many embodiments, including adaptations, variations, modifications, and equivalent arrangements, are implicitly disclosed herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention in any claim of a patent issuing here from, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term-differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112 (f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once during performance of the claimed method.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Further, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

FIG. 1 is an entity relationship diagram of an entertainment content exercise machine workout intensity control system 10 in accordance with one or more preferred embodiments of the present invention. The system 10 preferably includes one or more content sources 100, a workout manager 110, an exercise machine 120, a content player 130, and a content tagger 140, all for use by a workout user 200. Arrows indicate entities that "know about" other entities. The entity that "knows about" another entity is usually the entity that controls or initiates a relationship. Each of these elements is described in greater detail hereinbelow.

The content sources 100 provide access to entertainment content. Any mechanism that can deliver entertainment content can be a content source 100. Examples of content sources includes, without limitation, cameras, microphones, radio, cable and satellite TV and audio broadcast receivers, and Internet media providers like Amazon Prime®, Spotify®, YouTube®, and Apple TV®.

Content may be dynamic/live (sporting events, musical concerts, game engines, AI media generation), or static/pre-recorded (archived sporting events, TV shows, etc.). In some embodiments, the content may be primarily based on the performance of a musician, DJ, or band, on the performance of a workout leader, coach, or athlete, or the like. This allows for an unlimited variety of unique workout experiences. In a non-limiting example, a music band or "fitness DJ" could lead a live workout performance, in person or remotely, or could be pre-recorded.

The workout manager 110 is the processing and coordination hub of the system 10. The workout manager 110 is preferably implemented as a software application system, parts of which may run on web servers as a web application, or as one or more native applications on a laptop or desktop computer, or as one or more native applications on a smartphone, tablet computer, or other mobile device with remote components communicating over an electronic data communications network. In some embodiments, an implementation of the workout manager 110 may be split into multiple software components. In one example of such an implementation, a workout manager 110 may include frontend components that interact directly with the user and backend components that perform functions that do not interact directly with the user, such as computer and communications functions.

The workout manager 110 preferably monitors the content player 130 to determine play/paused state as well as which content is being played and at what position playback is occurring, retrieves workout intensity annotations for the currently playing content from the content tagger 140, controls workout intensity of the exercise machine 120 based on content playback position and intensity, monitors the actual resulting effort of the workout user as reported by the exercise machine 120, and provides a user interface (UI) for the workout user 200 in order to allow the user 200 to view and control workout status. In some embodiments, however, not all of these functions are implemented.

The workout manager 110 is interconnected with the exercise equipment 120, which may be any exercise equipment apparatus that incorporates digitally controllable workout resistance, effort, and/or intensity controls. Examples of types of exercise equipment suitable for use in various embodiments of the present invention include, without limitation, smart cycling trainers and smart treadmills. In at least some embodiments, the exercise machine 120 is also able to measure and report effort applied by the workout user 200.

As described and illustrated herein, the system 10 includes an exercise machine 120. However, it will be appreciated that in various embodiments, including various commercial embodiments, the other elements of the system 10 may be implemented separately from the exercise machine 120 and simply added (connected) thereto.

The content player 130 may be any media playback device or system by which users consume entertainment content. The content player 130 accesses content exposed by the content sources 100 and presents the content to the user 200. Examples of devices or systems suitable for use as a content player 130 include, without limitation, televisions and other video playback devices, DVRs, radios, podcast devices, music players, and video game consoles. Internet media player applications, such as YouTube®, Spotify®, or Apple TV®, may also serve as content players 130.

The content tagger 140 is a processing system that analyzes entertainment content retrieved from the content sources 100, derives workout intensity data from the content by assessing attributes of the content at various points in time, and then tags the content with workout intensity and timing annotations that are consumed by the workout manager 110 to determine the workout intensity of currently playing content at any point in time. In at least some embodiments, the annotations are percentage values (relative to a maximum intensity for the content) for various points in time or periods of time. The annotations, in turn, can be mapped or otherwise used to correspond to any workout parameter, including, without limitation, power (watts), weight or resistance, speed, intervals for repetitions, how long to hold static positions (i.e., yoga positions), and so on.

One type of content tagger 140 suitable for use in preferred embodiments of the present invention is a media classification platform, examples of which include, without limitation, the Music Genome Project (available at https://en.wikipedia.org/wiki/Music_Genome_Project) and the Spotify Audio Analysis API (available at https://developer.spotify.com/documentation/web-api/reference/#/operations/get-audio-analysis).

Another type of content tagger 140 suitable for use in preferred embodiments of the present invention is a real-time sports data feed converter, wherein a real-time sports data feed for a live sporting event is received and the feed data is converted into workout intensity data. Examples of sports data feed services include, without limitation, sportsdata.io (available at https://sportsdat.io/), mysportsfeeds (available at/www.mysportsfeeds.com/), and Sport Radar (available at https://developer.sportradar.com/docs/read/Home).

Another type of content tagger 140 suitable for use in preferred embodiments of the present invention is a real-time measured data converter, wherein a data feed is produced based on dynamic physical phenomena associated with one or more musician/athlete/fitness personality or their equipment or the like and then converted into workout intensity data. In another example, a cycling group leader's own intensity (as measured, for example, by the group leader's cycling trainer resistance) could be converted into suitable workout intensity data for use by the members of the group such that the group leader's workout intensity controls the workout intensity of everyone else in the group. In further examples, the group leader could themself be on an indoor trainer, riding around outside, or even participating in an event of their own, such as a professional cyclist riding in an event, e.g., the Tour de France®. In a still further example, the number of notes played by a musician (e.g., the drummer for a band named "Turkey Stop") could be tracked during a live or pre-recorded performance and converted into workout intensity data.

In the same way that content sources 100 may be dynamic/live vs. static/pre-recorded, a content tagger 140 may be implemented as a real-time process for dynamic content, or may utilize content that is pre-tagged in bulk for static content that does not change. In an example of the latter, musical recordings could be pre-tagged to save processing time during a workout.

In use, the workout user 200 controls playback of the content player 130 and applies effort to the exercise machine 120. The user 200 may also view workout status such as current workout intensity and/or upcoming workout intensity by monitoring a UI exposed by the workout manager 110. As the content from the content source 100 is presented to the user via the content player 130, the content tagger 140 provides synchronized intensity annotations to the workout manager 110, which in turn controls the workout "intensity" that is generated by the exercise machine 120 and experienced by the user 200 as the user 200 interacts with the machine 120.

Figure 2:
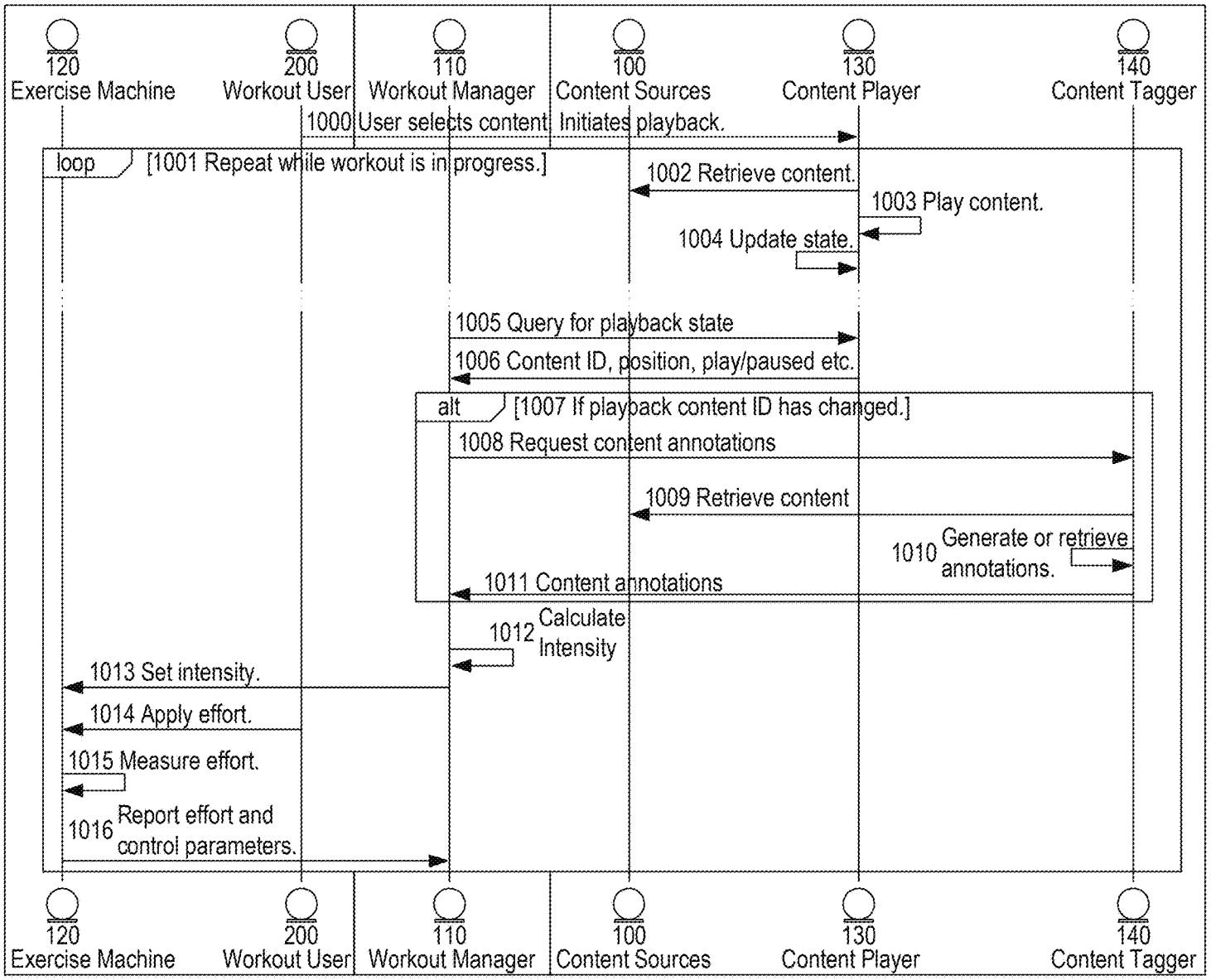
FIG. 2 is a sequence diagram illustrating an example of a possible sequence of activities that take place while a user is working out.

FIG. 2 is a sequence diagram illustrating an example of a possible sequence of activities that take place while a user 200 is working out. With reference to both FIGS. 1 and 2, a workout user 200 selects some content at step 1000 and initiates playback operations for the content using the content player 130. A group of steps, denoted collectively as sub-process 1001, are then repeated while content is playing. It will be appreciated, however that in various cases, the individual steps of repeating sub-process 1001 can be performed in different orders or even outside of the repeating loop. The sequence diagram of FIG. 2 thus represents one non-limiting example of how these operations may be sequenced.

Returning to FIG. 2, at step 1002, the content player 130 periodically retrieves content segments from the content sources 100 for playback. At step 1003, the content player 130 plays the retrieved segment of content, and at step 1004, the content player 130 updates its playback state, which can include current content ID data (artist, album, song, video, movie, show, podcast, etc.) and playback position in the content. Other playback state parameters or aspects may also be updated such as whether the user has paused or restarted playback, or is changing the playback position.

Meanwhile, at step 1005, the workout manager 110 monitors the playback state of the content player 130. This may be in the form of a query from the workout manager 110, as shown in FIG. 2, or the content player 130 may initiate contact with the workout manager 110 whenever playback state changes. At step 1006, the content player 130 returns state information to the workout manager 110 for assessment. In at least some embodiments, the state information that is returned is state change information, but alternatively the state information returned is compared to previous state information by the workout manager 110.

In at least some embodiments, when the content ID data received from the content player 130 indicates (such as via the content ID) that the content being played has changed, then it may be necessary for the workout manager 110 to obtain intensity annotations for the content if such annotations are not already cached or otherwise available. This might happen, for example, when a user changes a song or a show that is playing, when a content playlist transitions to new content, or the like. The workout manager 110 accomplishes this through communication with the content tagger 140 via a group of steps denoted collectively as sub-process 1007. The sub-process begins at step 1008, where the workout manager 110 requests content annotations for the currently playing content from the content tagger 140. It might also request and cache annotations for future content if that information is known, such as when a current content playlist is available. At step 1009, the content tagger 140 retrieves content from the content sources 100 and, at step 1010, the content tagger 140 scans the content. In a real-time tagging scenario for dynamic content, the content tagger may tag the content with workout intensity annotations. For static, pre-recorded content, the content tagger 140 may simply retrieve a cached, pre-computed set of annotations for the specified content, saving time and processing resources if the annotation process is lengthy or resource-intensive. Finally, at step 1011 of the sub-process 1007, the content tagger 140 returns the content annotations to the workout manager 110.

With the intensity annotations on hand, the workout manager 110 refers to the content annotations at step 1012 and calculates the current workout intensity for the currently playing content and position. The calculations may be relatively simple, such as scaling a 0%-100% content intensity value to a relative workout intensity (e.g., 0%-100%, 50%-150%, 0%-200%, etc.), or may involve more complicated operations. Then, at step 1013, the workout manager 110 converts the workout intensity to a target intensity parameter and communicates it to the exercise machine 120 so as to set the intensity level of the machine. As described previously, the "intensity" of the machine 120 is a variable physical phenomenon that is produced by the exercise machine 120 and experienced by the user 200 as the user 200 interacts with the machine 120. The variable physical phenomenon may be the physical resistance (such as pedaling resistance on a cycling trainer) applied by the exercise machine 120, an operational speed (such as belt speed on a treadmill) produced by the exercise machine 120, an operational angle (such as the incline of a treadmill) utilized by the exercise machine 120, a haptic effect (such as a level of vibration) generated by the exercise machine 120, or the like. The target intensity parameter is preferably provided in a form usable by the particular type of exercise machine 120 being utilized, and this target intensity parameter may be different for each type of fitness machine or activity. For example, in at least some embodiments, the exercise machine 120 is a smart cycling trainer whose pedaling resistance can be set by specifying a wattage that the user must generate. Alternatively, pedaling resistance could be set by specifying a simulated incline percentage (where the machine has been previously configured with the users weight), or by specifying a simulated speed so that the machine can calculate the workout intensity based on simulated wind resistance, simulated rolling resistance, or the like. In other embodiments, the exercise machine 120 is a smart treadmill whose belt speed or incline can be changed so that a user has to work harder or easier to match the intensity of the workout content.

It is up to the user 200 to decide how to respond to the change in intensity level of the exercise machine 120 by applying effort to the machine 120 at step 1014. For example, if the resistance of a smart cycling trainer increases, the user 200 may choose to maintain the same pedal revolution rate, thereby increasing the intensity level of the user's workout, or the user 200 may choose to reduce the pedal revolution rate because of the increased resistance. (This choice may be similar to that experienced, for example, when a user encounters a hill on a virtual cycling course while using a smart cycling trainer.) In many workouts, the intention is to adjust the intensity of the workout based on the input, and, in particular, to push the user 200 to adjust their effort to match the target, but it is still up to the user 200 as to how to respond.

Whatever the user 200 decides to do, the exercise machine 120 in at least some embodiments measures the actual effort of the workout user 200 at step 1015, and then, at step 1016, the exercise machine 120 reports the measured effort of the workout user 200 back to the workout manager 110, where it can then be provided as feedback to the user 200 as to how closely they are matching the workout target intensities. The measurement may be dependent upon the particular type of exercise machine 120 being utilized. For example, in at least some embodiments, the exercise machine 120 is a smart cycling trainer, and the measured output is provided in power (watts). Notably, how closely the user's effort matches the target intensity may be machine-dependent. Some machines are more accurate than others, or allow for more variance in the user's efforts. As part of step 1016, the exercise machine 120 may optionally also pass back other exercise machine control parameters (steering, shifting, etc.) that can be used by the workout manager 110 as control inputs for the workout.

Figure 3:
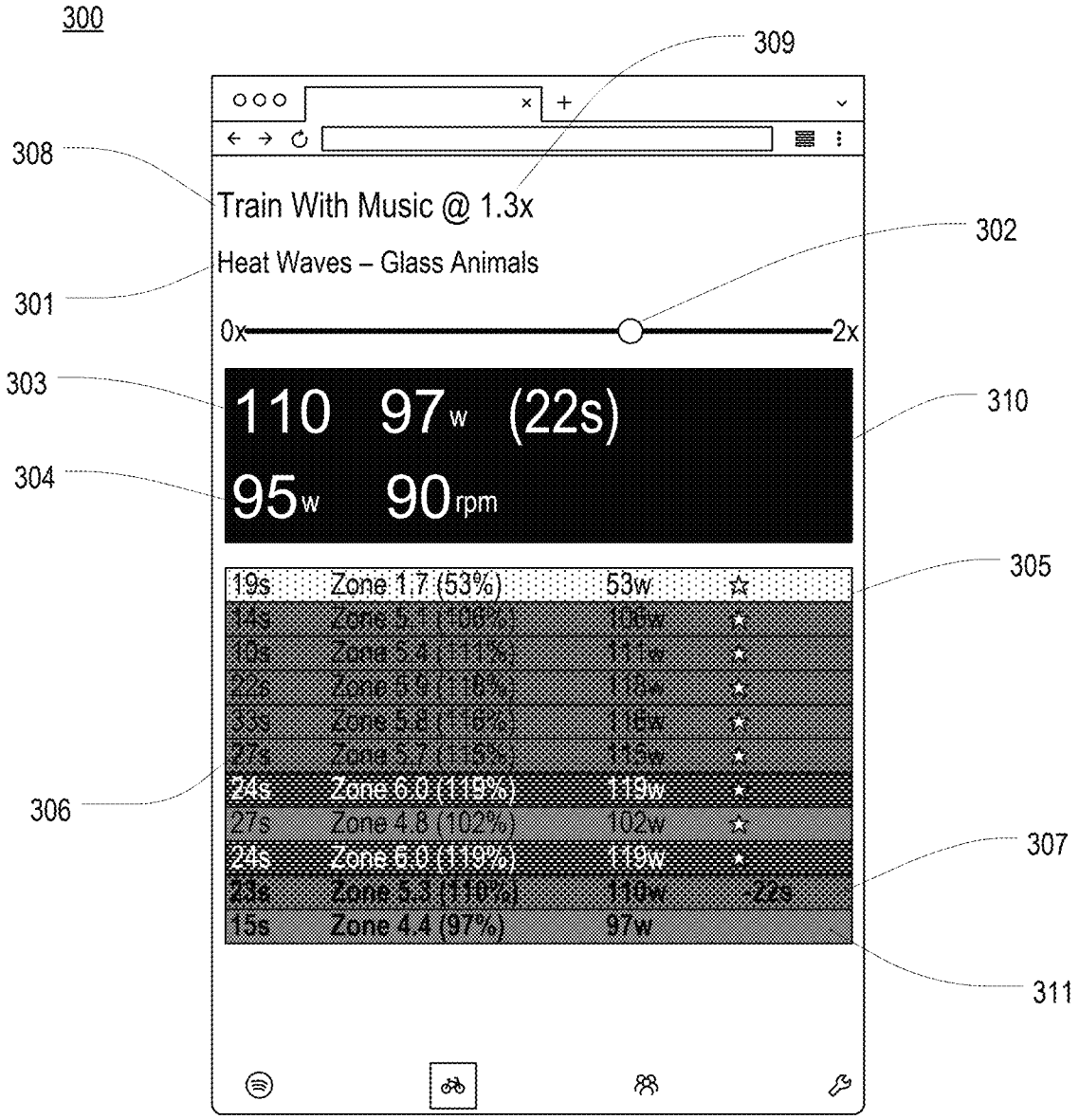
FIG. 3 is a screenshot from a display screen in a first exemplary workout manager content playback UI.

The UI exposed by the workout manager 110 for use by the user 200 may take any of a variety of forms. In this regard, FIG. 3 is a screenshot from a display screen 300 in a first exemplary workout manager content playback UI. The first exemplary workout manager content playback UI is shown implemented as an application on a smart phone. In the content playback UI of FIG. 3, display area 308 provides an indication of the content being utilized. In this particular screenshot, music content is being tracked, and workout intensities are created based on characteristics of different segments of the music content. However, as described hereinabove, different types of content may be utilized, both static and dynamic, and in various embodiments, the UI may selectively track other types of content, different content playback UI's may be provided for different types of content, and/or a content playback UI may have different screens for different types of content.

In FIG. 3, a particular song, identified in display area 301 as "Heat Waves" by "Glass Animals," is being played. The lower half of the screen displays a table 305 of song segments, within the song being played, wherein intensity and duration information for each segment are displayed to the user. More particularly, for each segment in the table 305, the following information is displayed left to right: the segment length (measured here in seconds), the segment training zone intensity and Functional Threshold Power ("FTP") percentage, the resulting target output for the segment (measured here in watts), and the segment completion status.

The training zone intensity and FTP percentage for each segment are based on the intensity annotations for the segment. FTP is generally defined as the workout intensity the user can maintain over an hour. In at least some embodiments, to correlate the intensity annotations for the segment to a desired workout intensity, the FTP percentage may be indexed to the annotations, wherein an "average" intensity in the song segment corresponds to an FTP percentage of 100%, while more intense or less intense segments have higher or lower FTP percentages accordingly. "Training zone intensity" is a commonly-used metric for categorizing the intensity of the user's output (and thus his or her workout) into simple, easy-to-recognize ranges or "training zones." Intensity annotations and/or FTP percentages can be likewise indexed to training zones. The resulting target output for the segment may then be determined based on the FTP percentage, for example, by multiplying the user's FTP (in the illustrated example, 100 watts) by the FTP percentage.

It will be appreciated that there are many ways to express workout intensities to the user. In the illustrated example, the display screen is specifically targeted at cyclists listening to music while riding on smart cycling trainers. FTP training zones are familiar to cyclists, thus making the use of such zones an easy way to accomplish the task of showing a workout user 200 quickly how easy or hard the different parts of a workout are going to be. However, other sports or workout and content combinations might use other UI methods to express workout intensity.

With regard to the segment completion status, a star is displayed for each song segment that has completed playing (for example, segment 306), while a different indicia (or nothing at all) is displayed for each song segment that has not yet started playing. For the current segment 307, the amount of time remaining in the segment may be displayed.

A central display area 310 may be provided to present some of the most relevant information regarding the workout. The information may be presented in a variety of ways, but in the illustrated embodiment, three pieces of information are shown from left to right in a first display line 303: the target user output (110 watts) for the current segment, the target user output (97 watts) for the next segment (so that the user 200 can easily discern what is coming up next in his or her workout), and the time remaining in the current segment (22 seconds) before transitioning to the next segment. Notably, information about the current segment 307 and the next segment 311 is also displayed in the segment table 305; in various embodiments, it is not necessary to display the information in both places.

In the illustrated embodiment, the central display area 310 also includes a second line 304 that presents information (from left to right) about the actual workout: the current user power output (95 watts) (as measured by the exercise machine 120), an icon confirming that a smart cycling trainer is being utilized, and the pedal cadence or speed on the cycling trainer (90 rpm). Because the actual output (95 watts) is lower than the target output (110 watts), the user 200 is not (at the moment represented in the screenshot of FIG. 3) actually matching the increased workout intensity dictated by the content segment 307. This may be intentional by the user 200, but by presenting the information to the user 200, the user at least has the opportunity to adjust his or her workout output accordingly.

The information displayed in the second line 304 (or corresponding portion of an alternative central display area) is preferably selected to match the particular workout type. In the exemplary screenshot illustrated in FIG. 3, power (wattage) and pedaling cadence are presented very familiar to cyclists. It will be appreciated, however, that for other sports or workout types, the user feedback metrics are preferably chosen to be familiar to participants of those workouts. Such metrics may include, for example, repetitions over time for weight lifting, activities completed for interval training, or time spent in poses for yoga.

Notably, other visual aids may be utilized to provide the user 200 with quickly recognizable information about the workout intensity dictated by the various segments. For example, the background of each segment in the table 305 may be color-coded or otherwise marked to give a user 200 a quick, easily-recognizable indication of the relative intensity for that segment. In at least some embodiments, the colors are selected to match commonly-used colors for FTP training zones. One suitable color code uses light grey for Zone 0 (0.0-0.9), dark grey for Zone 1 (1.0-1.9), blue for Zone 2 (2.0-2.9), green for Zone 3 (3.0-3.9), yellow for Zone 4 (4.0-4.9), orange for Zone 5 (5.0-5.9), and red for Zone 6 (6.0 and above). In at least some embodiment, such color-coding is additionally or alternatively applied to the numerical wattages/intensities in the first line 303 of the central display area 310.

In at least some embodiments, the user 200 may be provided with the ability to adjust the intensity levels to which the content and its intensity annotations are scaled. In at least some embodiments, this may be accomplished by providing an input control for setting a multiplier for the intensity levels tagged in the content. For example, in the illustrated embodiment, a slider 302 is provided to let the user increase or decrease his or her workout intensity when desired. This may be useful if a user 200 finds a song to be too "easy" (less intense) or "hard" (more intense), or if a user 200 simply wishes to adjust the intensity of their workout. In this embodiment, the slider 302 provides real-time adjustment to the intensity levels of the content, and the adjustment remains in place until the user 200 changes it again (or until the application or system is reset). In the exemplary screenshot of FIG. 3, the slider 302 may be used to set a multiplier in 0.1× increments of anywhere from 0× (0%) to 2× (200%) the intensity levels tagged in the content, and is currently set at 1.3 times (1.3×, or 130% of) the intensity levels of the content. In at least some embodiments, the current setting 309 may be displayed along with the position of the slider 302.

Figure 4A:
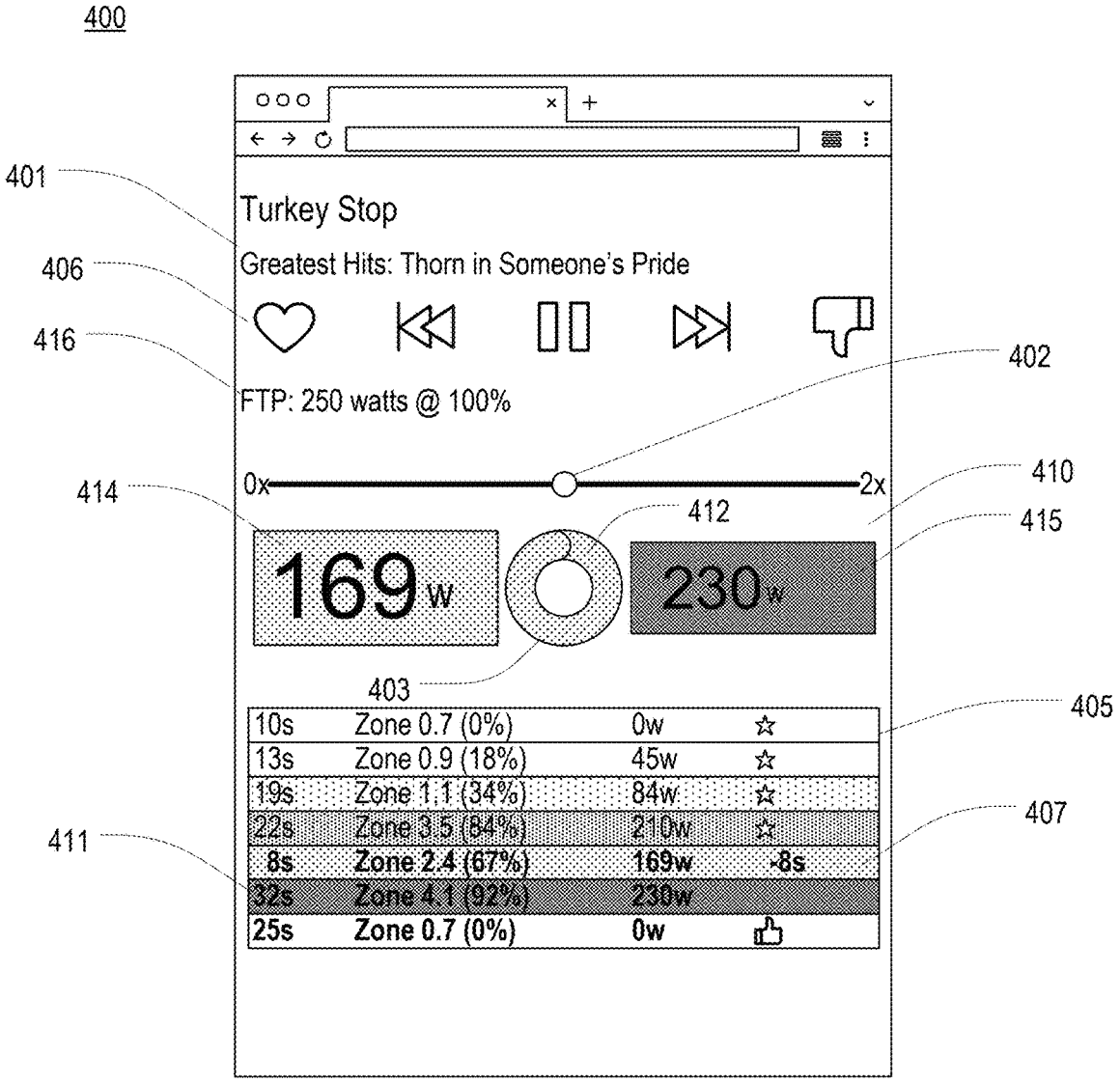
FIGS. 4A-4C are screenshots from a display screen in a second exemplary workout manager content playback UI.
Figure 4B:
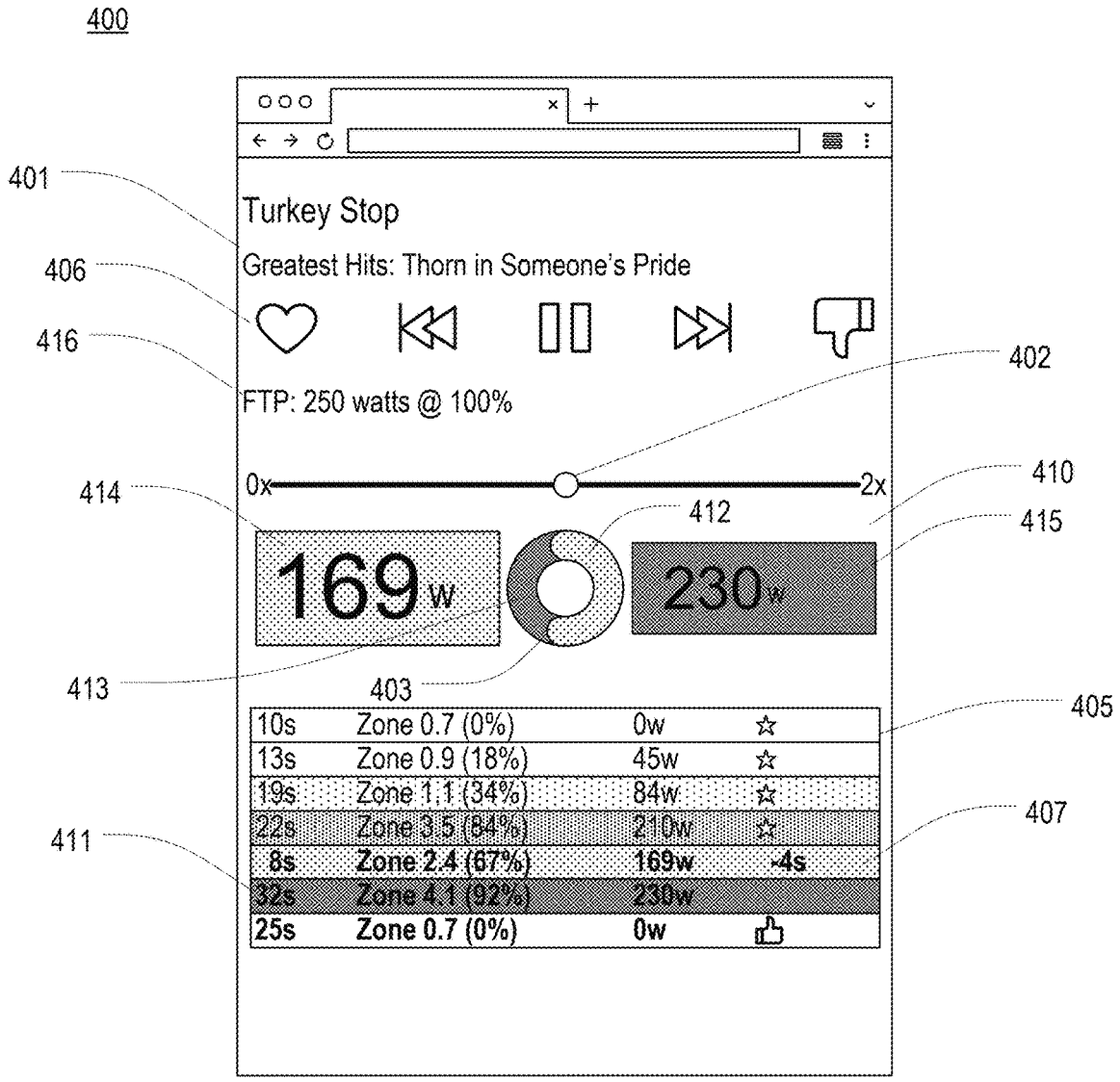
Figure 4C:
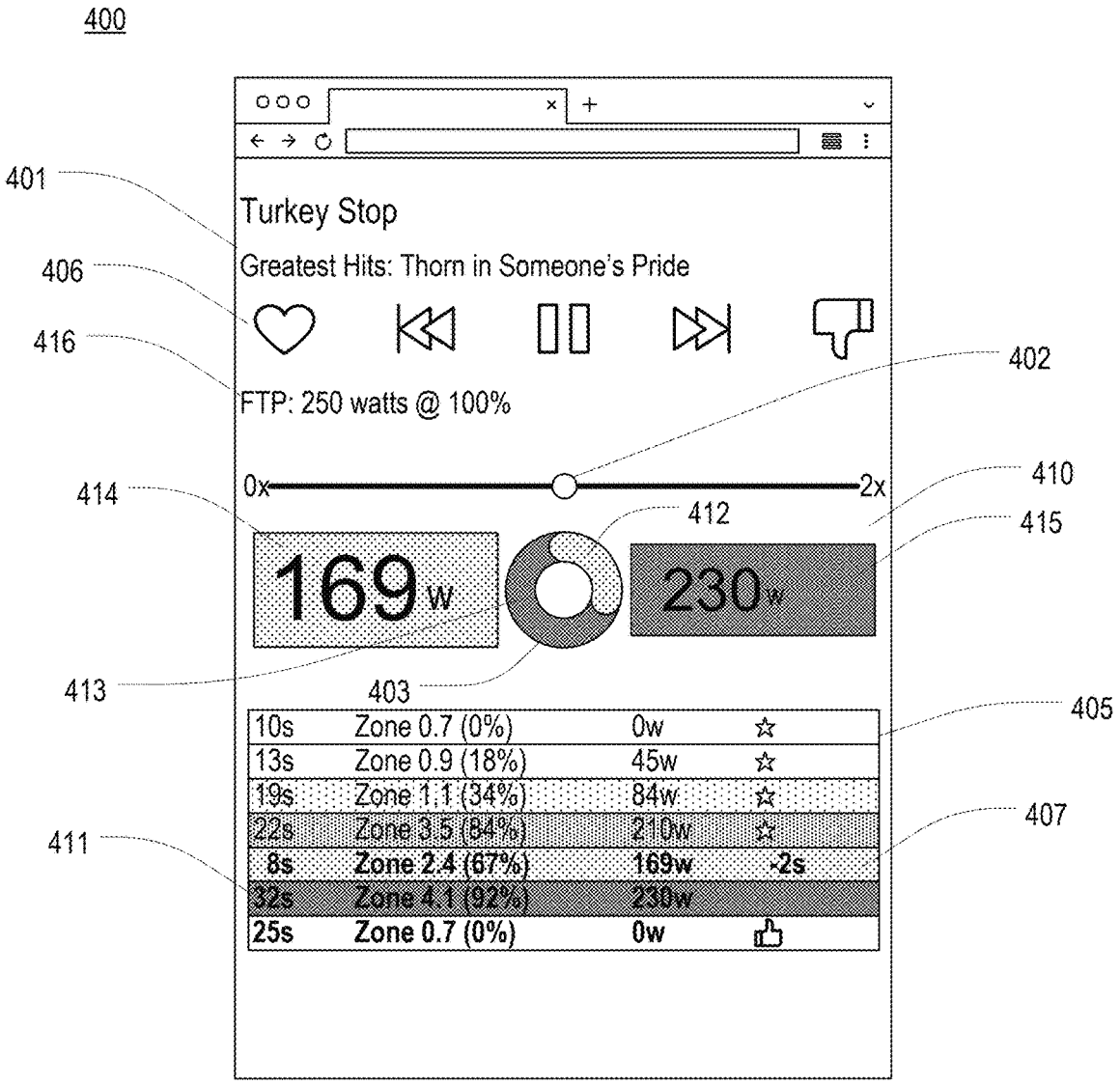

FIGS. 4A-4C are screenshots from a display screen 400 in a second exemplary workout manager content playback UI. As with the first exemplary UI, the second exemplary workout manager content playback UI is shown implemented as an application on a smart phone. Similar to the UI illustrated in FIG. 3, the exemplary workout manager content playback UI of FIGS. 4A-4C is shown tracking music content and displaying workout intensities based on characteristics of different segments of the music content. As with the UI illustrated in FIG. 3, a song, identified in display area 401 as "Greatest Hits: Thorn in Someone's Pride" by "Turkey Stop," is being played. The lower half of the screen displays a table 405 of song segments, within the current song, wherein intensity and duration information for each segment are displayed to the user. More particularly, for each segment in the table 405, the following information is displayed left to right: the segment length (measured here in seconds), the segment training zone intensity and FTP percentage, the resulting target output for the segment (measured here in watts), and the segment completion status. Also as with the UI illustrated in FIG. 3, a slider 402 is provided to let the user increase or decrease his or her workout intensity when desired.

In the UI of FIGS. 4A-4C, an area 416 may be provided to display information about the user's base FTP, which for the current user is shown to be 250 watts at 100% of their FTP. Optionally, this area 416 may be adjusted based on the position of the slider 402. It will be appreciated that such an area may be provided in the UI of FIG. 3 as well.

A central display area 410 may be provided to present some of the most relevant information regarding the workout. A first portion 414 provides a numerical indication of the target user output (169 watts) for the current segment, and a second portion 415 provides a numerical indication of the target user output (230 watts) for the next segment (so that the user 200 can easily discern what is coming up next in his or her workout). These target user outputs match the outputs displayed in the table 405 for the current segment 407 and the next segment 411. The respective backgrounds of the first and second portions 414,415 are preferably color-coordinated with the backgrounds of the current and next segment entries 407,411, respectively, in the table 405 below. For example, the first portion 414, which pertains to the current segment, may be color-coded blue to indicate intensity Zone 2, while the second portion 415, which pertains to the subsequent segment, may be color-coded yellow to indicate intensity Zone 4.

The central display area 410 also provides an animated element 403 in the middle of the central display area 410 to provide the user 200 with a visualization of the time remaining in the current content segment. As shown in FIG. 4A, the animated element 403 is circular and includes a first section 412, preferably color-coordinated with the background of the first portion 414 and with the background of the current segment entry 407 in the table 405 below, that is proportional to the amount of time remaining in the current workout segment before starting the next workout segment. As the segment is played, a second section 413 of the circular animated element 403 is progressively uncovered, as shown in FIGS. 4B and 4C. The second section 413 is preferably color-coordinated with the background of the second portion 415 of the central display area 410 and with the background of the next segment entry 411 in the table 405 below. The remaining time is also displayed numerically in the current segment entry 407 in the table 405, and can be seen to be 8 seconds in FIG. 4A (i.e., the content segment, which can be seen in that entry 407 to be 8 seconds long, has just started playing), 4 seconds in FIG. 4B, and 2 seconds in FIG. 4C. It will be appreciated that the animated element 403 would move twice as fast for a 30 second content segment as it would for a 60 second segment, thereby giving a visual indication to the workout user 200 of the relative time remaining in the current workout segment and how soon they will feel the intensity change for the next workout segment.

The display screen 400 of FIGS. 4A-4C also includes a further display area 406 comprising a row of media transport icons. In the illustrated embodiment, the center three icons represent conventional play/pause, previous track, and next track functions. On the left end is a heart icon for marking content tracks that are particularly useful for working out, and on the right end is a thumbs-down icon for skipping past the current track and marking it as not useful for the user. Other icons and corresponding control functions may additionally alternatively be provided.

In various embodiments of the present invention, further features offered by an exercise machine may be incorporated into system operations. For example, in addition to reporting applied effort, some exercise machines are equipped with additional user controls that can be used to control the workout experience. These controls may, for example, be used to control playback of the entertainment content. For example, a steering control on a cycling trainer could be used to control the speed of music or video playback by steering left and right. Other controls like cycling brakes or shifting levers can also be used to control the workout experience in a similar way.

Furthermore, some exercise machines are capable of supplying additional feedback to the workout user 200 beyond changing the physical resistance or intensity offered by the machines. For example, some cycling trainers support a haptic "road feel" feature where the trainer vibrates the bike in different ways to simulate different types of road surfaces such as pavement, gravel, bricks, or cobblestones. A smart cycling trainer or smart treadmill might also offer the option to change the inclination of the exercise machine and user in order to simulate climbing or descending hills. These additional forms of user feedback can be used by the workout manager 110 to change the workout experience based on the content that is being played. For example, more vibration and road feel may be engaged for loud music, and then less road feel may be used for a quieter passage. Similarly, the inclination of an exercise machine may be increased as entertainment content audio volume or tempo builds, and then the inclination may be reduced as the entertainment content calms down to a lower intensity. In this way, the workout user 120 is given a richer workout experience where the effort and intensity they are experiencing is authentically matched to the content being provided from the content sources 100.

Advantageously, a system is thus provided that connects entertainment content intensity to controllable fitness equipment so the workout user no longer has to concern themselves with manually adjusting the intensity of their workout in order to hit power or intensity targets that could be changing rapidly. Instead the fitness equipment changes the workout intensities, freeing the user to focus on the fitness experience itself.

It will also be appreciated that the system and methods of the present invention may be combined with the teachings of the '023 publication to enable a user to "play along" with a sporting event that they are watching, or in some cases with music or other types of content.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claim(s) appended hereto and the equivalents thereof.

What is claimed is:

1. A computer-implemented method providing a technical solution to the technical problem of using entertainment content to automatically control an operational aspect of an exercise machine to adjust an intensity of a workout performed by a user, the method comprising:

(a) playing entertainment content via a content player such that the entertainment content is presented to a user, wherein the entertainment content is already tagged with synchronized intensity and timing annotations correlating to attributes of the entertainment content at various points in time;

(b) as the entertainment content is presented to the user, providing the synchronized intensity and timing annotations with which the entertainment content is tagged to a workout manager;

(c) receiving the intensity and timing annotations at the workout manager;

(d) at the workout manager, processing the intensity and timing annotations to determine a target intensity parameter for each of a plurality of segments of the entertainment content;

(e) as the entertainment content is played, providing the target intensity parameter for each respective segment, of the plurality of segments of the entertainment content, to an exercise machine; and (f) in response to receiving each target intensity parameter for each respective segment, controlling an operational aspect of the exercise machine to adjust an intensity of a workout performed by the user for the duration of the respective segment, thereby synchronizing the intensity of the workout with the attributes of the entertainment content;

(g) wherein the workout manager receives the previously-tagged intensity and timing annotations for the entertainment content and automatically generates a workout experience having various changes in workout intensity based on the annotations and controls the exercise machine in synchronization with the playing of the entertainment content.

2. The computer-implemented method of claim 1, wherein the step of processing the intensity and timing annotations to determine a target intensity parameter for each of a plurality of segments of the entertainment content includes independently calculating, by the workout manager, a workout intensity for the segment and converting the workout intensity to the target intensity parameter at least partly based on a particular type of exercise machine chosen by the user.

3. The computer-implemented method of claim 2, wherein controlling an operational aspect of the exercise machine to adjust the intensity of the workout performed by the user includes controlling the physical effort required of the user by the exercise machine.

4. The computer-implemented method of claim 3, wherein the exercise machine is a smart cycling trainer, and wherein controlling the physical effort required of the user by the exercise machine includes controlling pedaling resistance of the smart cycling trainer.

5. The computer-implemented method of claim 3, wherein the exercise machine is a smart treadmill, and wherein controlling the physical effort required of the user by the exercise machine includes controlling belt speed of the smart treadmill.

6. The computer-implemented method of claim 3, wherein the exercise machine is a smart treadmill, and wherein controlling the physical effort required of the user by the exercise machine includes controlling a belt incline of the smart treadmill.

7. The computer-implemented method of claim 2, wherein controlling an operational aspect of the exercise machine includes controlling haptic feedback by the exercise machine to the user.

8. The computer-implemented method of claim 7, wherein the exercise machine is a smart cycling trainer, wherein the entertainment content includes immersive video featuring different cycling surfaces, and wherein controlling haptic feedback includes generating different vibration patterns, via the smart cycling trainer, in synchronization with the different cycling surfaces.

9. The computer-implemented method of claim 2, wherein controlling an operational aspect of the exercise machine includes controlling the physical orientation of the exercise machine.

10. The computer-implemented method of claim 9, wherein the exercise machine is a smart cycling trainer, and wherein controlling the physical orientation of the exercise machine includes controlling an incline of the smart cycling trainer.

11. The computer-implemented method of claim 9, wherein the exercise machine is a smart treadmill, and wherein controlling the physical orientation of the exercise machine includes controlling belt incline of the smart treadmill.

12. The computer-implemented method of claim 2, wherein a desired training zone intensity is correlated to the calculated workout intensity for each segment, and while each respective segment of the entertainment content is presented to the user, the training zone intensity for such segment is displayed to the user.

13. The computer-implemented method of claim 12, wherein, while each respective segment of the entertainment content is presented to the user, the training zone intensity for one or more additional segments of the entertainment content are also simultaneously displayed to the user.

14. The computer-implemented method of claim 12, wherein each training zone intensity is categorized using a fitness model that includes functional threshold power (FTP), training zones, or both.

15. The computer-implemented method of claim 14, wherein each training zone intensity is displayed using a color from a color-coded target intensity parameter range.

16. The computer-implemented method of claim 2, further comprising a step of tagging the entertainment content with the intensity and timing annotations via a content tagger.

17. The computer-implemented method of claim 16, wherein the step of tagging the entertainment content is carried out during the step of playing the entertainment content.

18. The computer-implemented method of claim 16, wherein the step of tagging the entertainment content is carried out ahead of time and the intensity and timing annotations are stored with the entertainment content for later execution of the playing step and the processing step.

19. A computer-implemented method providing a technical solution to the technical problem of using annotated entertainment content to automatically control an operational aspect of an exercise machine to adjust an intensity of a workout performed by a user, the method comprising:

(a) playing entertainment content via a content player, under control of a workout manager, such that the entertainment content is presented to a user while the user is exercising on an exercise machine of a particular type of the user's choosing;

(b) at the workout manager, receiving, from a content tagger, intensity and timing annotations, associated with the entertainment content, that correlate to attributes of the entertainment content at various points in time;

(c) for each segment of a plurality of segments of the entertainment content, independently calculating, by the workout manager, a target intensity parameter for the segment based on the intensity and timing annotations and based on the particular type of exercise machine chosen by the user; and (d) as the entertainment content is played, providing the target intensity parameter for each respective segment, of the plurality of segments of the entertainment content, to the exercise machine being used by the user such that an operational aspect of the exercise machine is controlled in order to adjust an intensity of a workout performed by the user for the duration of the respective segment, thereby synchronizing the intensity of the workout with the attributes of the entertainment content.

* * * * *